US006401499B1

(12) United States Patent
Clark et al.

(10) Patent No.: US 6,401,499 B1
(45) Date of Patent: Jun. 11, 2002

(54) AIR PUMP BULK DISPENSER

(75) Inventors: Brian D. Clark, Des Moines; Ted L. Hansen, North Liberty; Daniel F. Wunderlich, Newton, all of IA (US)

(73) Assignee: Maytag Corporation, Newton, IA (US)

( * ) Notice: Subject to any disclaimer, the term of this patent is extended or adjusted under 35 U.S.C. 154(b) by 29 days.

(21) Appl. No.: 09/629,011

(22) Filed: Jul. 31, 2000

(51) Int. Cl.[7] ..... D06F 39/02
(52) U.S. Cl. ..... 68/17 R
(58) Field of Search ..... 68/17 R, 12.18; 134/99.2

(56) References Cited

U.S. PATENT DOCUMENTS 3,094,247 A * 6/1963 Marchi ..... 68/17 R X
5,046,336 A 9/1991 Ferguson et al. ..... 68/17 R
5,195,338 A 3/1993 Russo ..... 68/12.18
5,226,301 A 7/1993 Rizzetto et al. ..... 68/17 R
5,758,521 A 6/1998 Roberts ..... 68/17 R

FOREIGN PATENT DOCUMENTS

EP 0449060 * 10/1991 ..... 68/17 R
GB 2214524 * 9/1989 ..... 68/17 R

* cited by examiner

*Primary Examiner*—Philip Coe
(74) *Attorney, Agent, or Firm*—McKee, Voorhees & Sease, P.L.C.

(57) ABSTRACT

An improved laundry washing machine is provided with multiple fluid storage tanks for fluid detergent, bleach, and/or fabric softener. An air pump pressurizes the tanks when the door of the washing machine is opened. Each tank is in fluid communication with an associated fluid compartment. A user can push a control button to open a valve to selectively deposit a desired amount of fluid from a tank into the associated compartment for a wash cycle.

10 Claims, 3 Drawing Sheets

AIR PUMP BULK DISPENSER

BACKGROUND OF THE INVENTION

Field of the Invention

Conventional laundry washing machines have individual compartments for various washing products such as detergents, bleach, and fabric softeners. The user selectively fills each compartment for each load of laundry. Each fill of the compartments requires that the product be taken from its storage location, such as a shelf or cabinet, opened, poured, closed, and replaced in storage. Each of these steps takes time, which is increased when multiple products are used for a specific load of laundry.

Therefore, a primary objective of the present invention is the provision of an improved washing machine having one or more fluid tanks for containing relatively large quantities of washing products, which can be selectively pumped into smaller compartments for each wash load.

Another objective of the present invention is the provision of an improved washing machine having multiple fluid storage tanks with a single air pump to pressurize the fluid tanks for pumping the respective fluids into associated compartments for a wash cycle.

Another objective of the present invention is the provision of an improved washing machine having large fluid storage tanks for wash products, such as liquid or fluid detergent, bleach, and fabric softener, which is easy and quick to use.

These and other objectives become apparent from the following description of the invention.

SUMMARY OF THE INVENTION

The improved washing machine of the present invention includes a cabinet with a tub mounted therein. An opening is provided in the front or top of the cabinet to provide access to the tub. A door on the cabinet is moveable between open and closed positions relative to the access opening.

The plurality of fluid tanks are mounted within the cabinet. Each tank is in fluid communication with a separate, smaller compartment. A single diaphragm air pump is actuated by a switch when the door is opened so as to pressurize each tank. A manually operated valve allows a user to switch compartment or compartments to fill with a desired amount of liquid or fluid detergent, bleach, and/or fabric softener. An easy access inlet conduit is provided for each tank so that the tank can be filled quickly and easily. A removable cap closes each fill conduit.

DETAILED DESCRIPTION OF THE DRAWINGS

Figure 1:
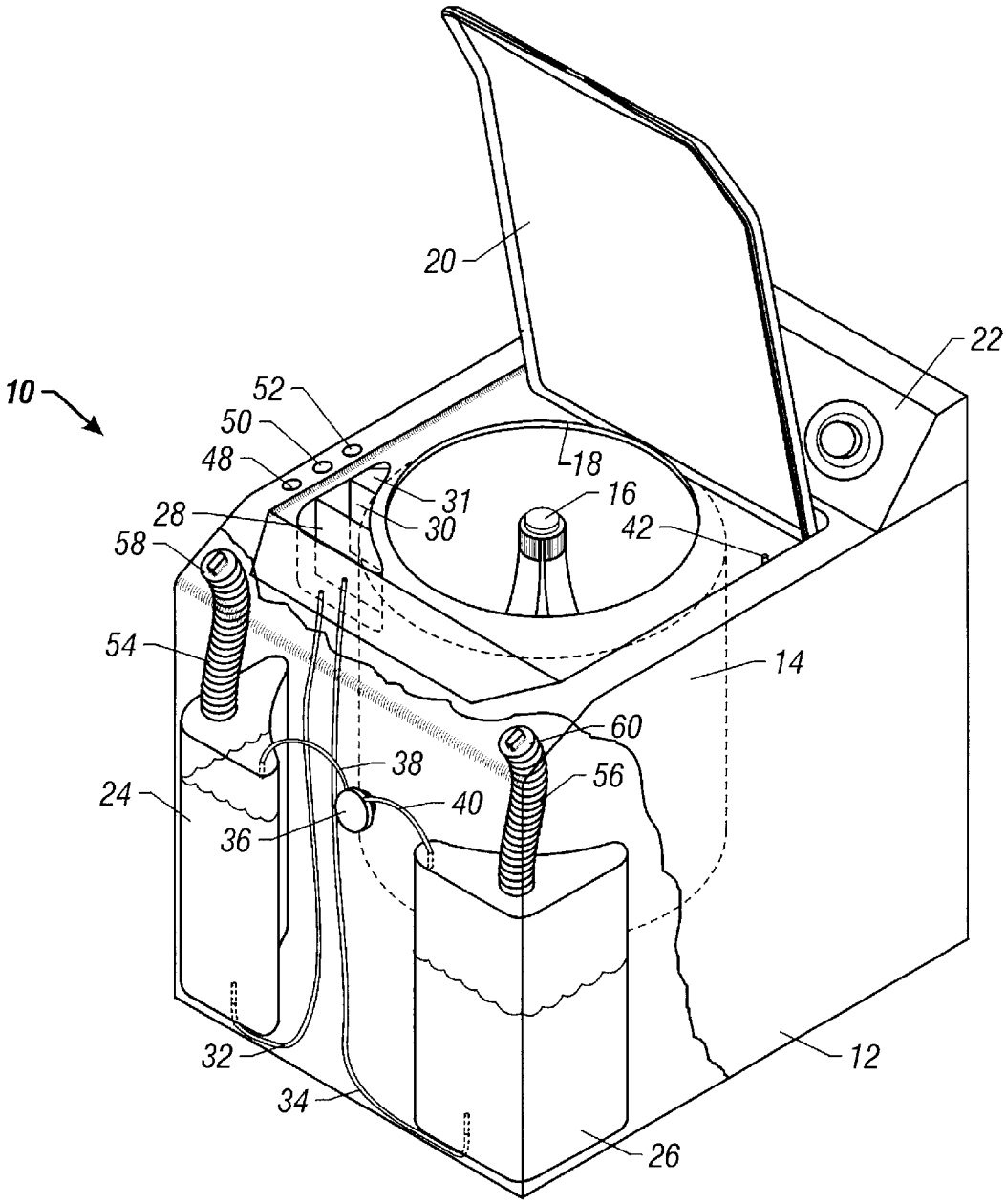
FIG. 1 is a perspective view of the improved washing machine of the present invention with a portion of the cabinet broken away to show two of the fluid tanks.
Figure 2:
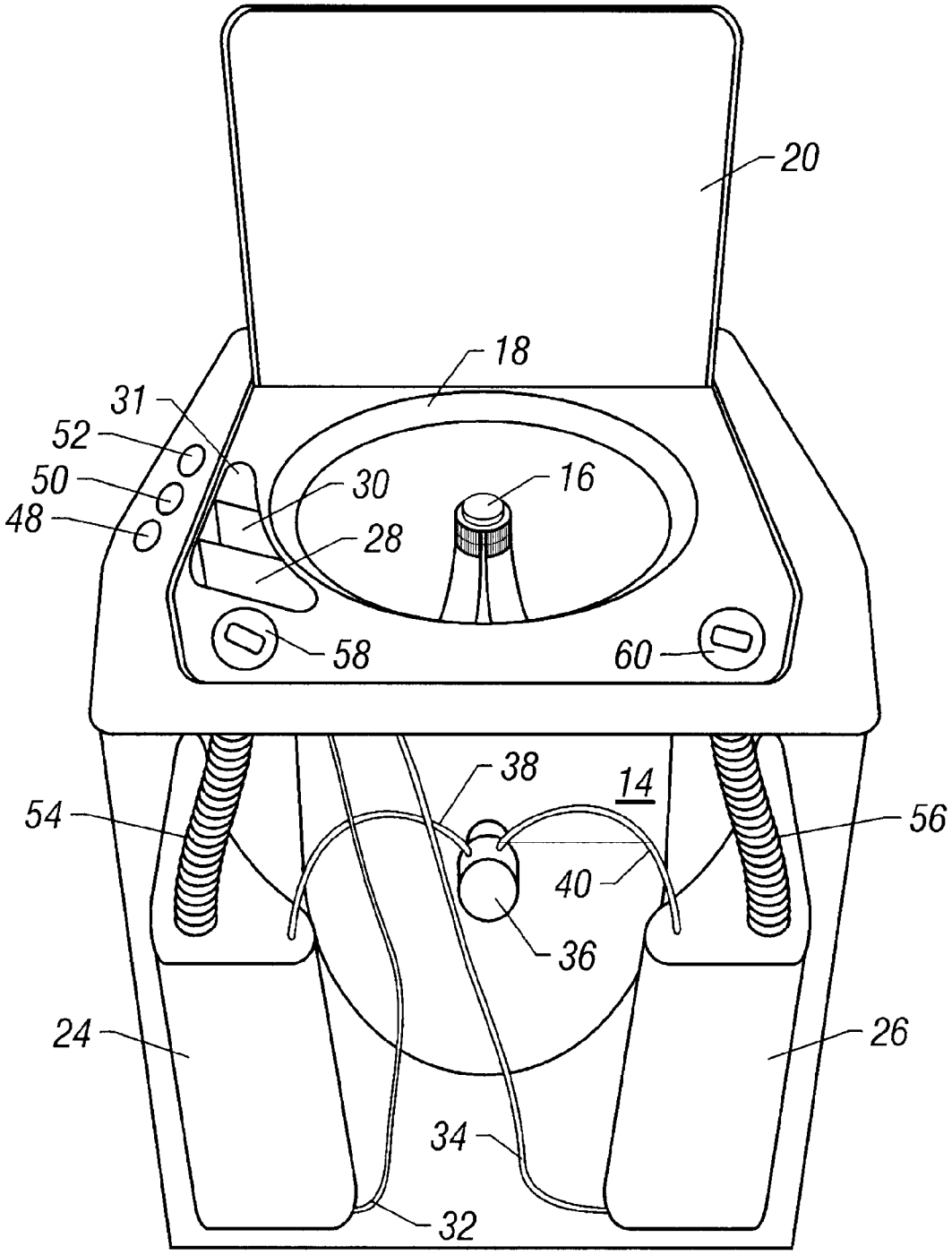
FIG. 2 is a view similar to FIG. 1 from a front perspective.
Figure 3:
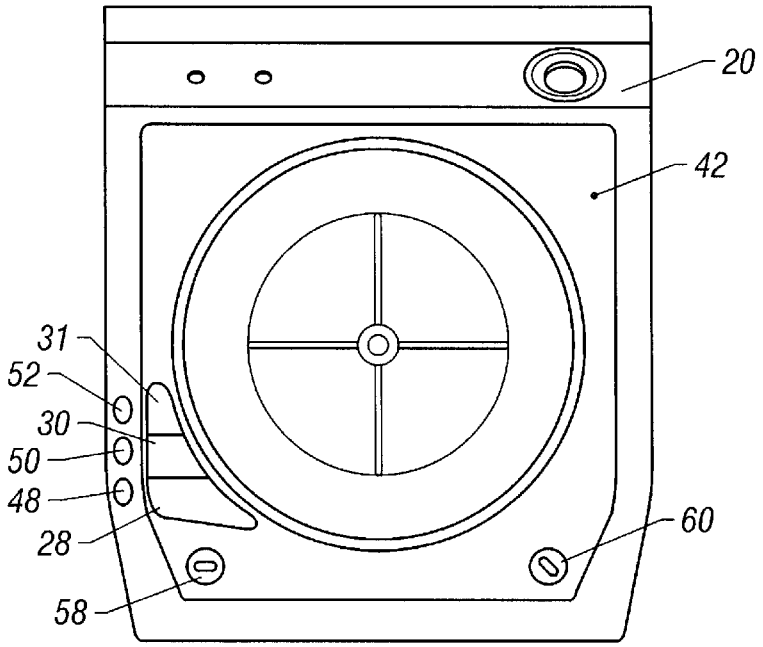
FIG. 3 is a top plan view of the washing machine of FIG. 1, with the door removed for clarity.
Figure 4:
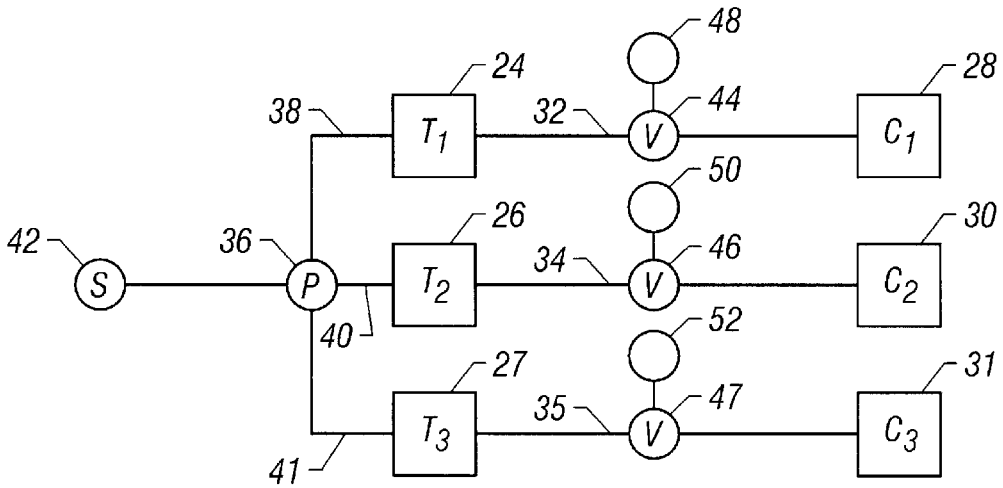
FIG. 4 is a schematic view of the pump, tank, valve and container layout for the dispenser.

The reference numeral 10 generally designates the improved washing machine of the present invention. The machine 10 includes a cabinet 12, with a tub 14 operatively mounted therein. An agitator 16 may be provided in the tub 14. The cabinet 12 includes an opening 18 providing access to the tub 14. A door 20 is hinged to the cabinet 12 so as to be moveable between open and closed positions relative to the access opening 18. A control panel 22 is provided on the machine 10 to control the operation thereof.

The above structure of the washing machine 10 is conventional and does not constitute a part of the present invention.

The present invention is directed towards a plurality of fluid tanks and associated compartments for containing the wash products, such as liquid or fluid detergent, bleach, and fabric softener. More particularly, the cabinet 12 includes a first fluid tank 24, a second fluid tank 26, a first fluid compartment 28 and a second fluid compartment 30. The first tank 24 is associated with the first compartment 28 via a first fluid line 32, while the second tank 26 is associated with the second compartment 30 via a second fluid line 34. The cabinet 12 may also include a third fluid compartment 31 which is associated with a third tank (not shown) via a third fluid line (not shown).

An air pump 36 includes a first air line 38 extending to the first fluid tank 24 and a second air line 40 extending to the second fluid tank 26. If a third fluid tank is provided, a third air line is provided from the pump 36. The pump is actuated by a switch 42, which is activated when the door 20 is moved to the open position. Upon actuation, the pump 36 pumps air through the lines 38, 40 into the tanks 24, 26, respectively so as to pressurize the tanks.

Each fluid line 32, 34 includes a valve 44, 46, respectively to control the flow of fluid from the tanks 24, 26 to the compartments 28, 30, respectively. The valves 44, 46 are normally closed, and are opened by a user depressing a first push button 48 or a second push button 50, respectively. A third push button 52 is provided to control a third valve (not shown) for the third tank (not shown).

First and second conduits 54, 56 are provided for filling the tanks 24, 26 respectively. Preferably, the conduits 54, 56 have an upper end extending to the top or front of the cabinet 12 which is closed by a removable airtight cap 58, 60, respectively. The lower end of each conduit 54, 56 extends into the respective tanks 24, 26. Therefore, a user can easily fill the tanks 24, 26 by moving the caps 58, 60 and pouring the detergent, bleach or fabric softener into the appropriate tank.

In operation, the door 20 is opened to activate the switch 42, and thereby the pump 36 so as to pressurize the tanks 24, 26. The user selects which products to use for the particular wash load, and presses the respective buttons 48, 50, 52, such that the compartments 28, 30, 31 are filled with a desired amount of detergent, bleach, and/or fabric softener. The remainder of the wash cycle proceeds in a conventional manner. The user has the option of manually filling compartments 28, 30 and 31 instead of using the bulk dispensing feature.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A washing machine comprising:

a cabinet;

a tub mounted in the cabinet;

a first bulk fluid tank within the cabinet;

a first fluid compartment in the cabinet and being in fluid communication with the tub;

a first fluid line providing fluid communication between the first fluid tank and the first fluid compartment;

an air pump operatively connected to the first tank for pressurizing the first fluid tank;

a switch for actuating the pump; and a first valve for controlling flow of fluid from the first tank to the first compartment.

2. The washing machine of claim 1 further comprising:

a second bulk fluid tank in the cabinet;

a second fluid compartment in the cabinet and being in fluid communication with the tub;

a second fluid line providing fluid communication between the second fluid tank and the second fluid compartment;

a second valve for controlling flow of fluid from the second tank to the second compartment; and the pump being operatively connected to the second tank for pressurizing the second tank.

3. The washing machine of claim 2 wherein the first and second tanks are adapted to contain different fluids.

4. The washing machine of claim 1 wherein the first valve is manually operated to deliver a desired amount of fluid from the first tank to the first compartment.

5. The washing machine of claim 1 wherein the cabinet includes an opening for access to the tub and a door movable between open and closed positions relative to the opening, the switch being activated when the door is moved to the open position, thereby actuating the pump.

6. An improved washing machine having a cabinet, a tub mounted in the cabinet, an opening in the cabinet to provide access to the tub, and a door on the cabinet movable between open and closed positions relative to the opening, the improvement comprising:

multiple fluid tanks within the cabinet, each fluid tank being adapted to store a different fluid;

multiple fluid compartments within the cabinet, each compartment being adapted to receive fluid from one of the respective fluid tanks;

an air pump in the cabinet and being operatively connected to each of the fluid tanks for pressurizing the fluid tanks; and multiple valves in the cabinet, each valve being operatively connected to one of the fluid tanks and one of the fluid compartments to control flow of fluid from the fluid tank to the fluid compartment.

7. The improved washing machine of claim 6 wherein each of the valves is manually activated to deliver a desired amount of fluid from the one fluid tank to the one fluid compartment.

8. The improved washing machine of claim 6 further comprising a switch to activate the air pump, the switch being activated when the door is moved to the open position.

9. The improved washing machine of claim 6 wherein the pump is a diaphragm air pump.

10. The improved washing machine of claim 6 further comprising multiple fluid inlet conduits, each having an upper end mounted in the cabinet and a lower end in one of the fluid tanks to allow filling of the fluid tank with fluid, and multiple removable caps each adapted for closing the upper end of each conduit.

* * * * *